United States Patent [19]

Greey

[11] 4,415,408

[45] Nov. 15, 1983

[54] APPARATUS, AND METHOD FOR CONTROLLING CONSISTENCY

[75] Inventor: David N. Greey, Toronto, Canada

[73] Assignee: General Signal Corporation, Rochester, N.Y.

[21] Appl. No.: 317,354

[22] Filed: Nov. 2, 1981

[51] Int. Cl.[3] ..... D21F 1/08

[52] U.S. Cl. ..... 162/198; 73/61 R; 73/861.25; 162/258; 162/263

[58] Field of Search ..... 162/49, 198, 258, 263; 73/61 R, 861.25

[56] References Cited

U.S. PATENT DOCUMENTS

| | | | |
|---|---|---|---|
| 2,280,632 | 4/1942 | Cram | 265/11 |
| 2,437,715 | 3/1948 | Thorp et al. | 92/46 |
| 2,627,788 | 2/1953 | Staege | 92/44 |
| 2,966,056 | 12/1960 | Heller | 73/61 R |
| 3,035,967 | 5/1962 | Sacksen et al. | 162/191 |
| 3,093,998 | 6/1963 | Albertson et al. | 73/61 |
| 3,195,866 | 7/1965 | Coats | 162/258 |
| 3,285,058 | 11/1966 | Ostroot | 73/59 |
| 3,430,625 | 3/1969 | McLeod, Jr. | 128/205 |
| 3,528,281 | 9/1970 | Cowan | 73/61 |
| 3,553,636 | 1/1971 | Baird | 73/61 R |
| 3,733,888 | 5/1973 | Danforth | 162/198 |
| 3,737,844 | 6/1973 | Yokoyama | 73/61 R |
| 3,791,200 | 2/1974 | Hayre | 73/67.1 |
| 3,954,119 | 5/1976 | Kunioka | 137/92 |
| 3,962,581 | 6/1976 | Zimmerman | 250/341 |
| 4,015,464 | 4/1977 | Miller et al. | 73/61 R |

OTHER PUBLICATIONS

Waller, "Guidelines For Applying Doppler Acoustic Flowmeters", In Tech, Oct. 1980, pp. 55–57.

Versabrite Sensor 2220 (Advertisement).

*Primary Examiner*—Steve Alvo

*Attorney, Agent, or Firm*—Martin Lukacher; Jeffery S. Mednick

[57] ABSTRACT

Consistency of slurries such as paper pulp stock is controlled by ultrasonically measuring the flow of the slurry (the velocity of the particles therein) as the slurry is agitated by an impeller which induces circulation thereof within a region in a tank containing the slurry. Dilutant is added under the control of the measurement and a mixed slurry of desired consistency is obtained, respectively at an inlet and an outlet in communication with the region of the tank where flow is being induced and measured. Consistency control is obtained in the containing vessel or tank with greater accuracy and at lower cost than in apparatus where consistency is measured outside of the vessel containing the slurry.

16 Claims, 2 Drawing Figures

FIG. 1
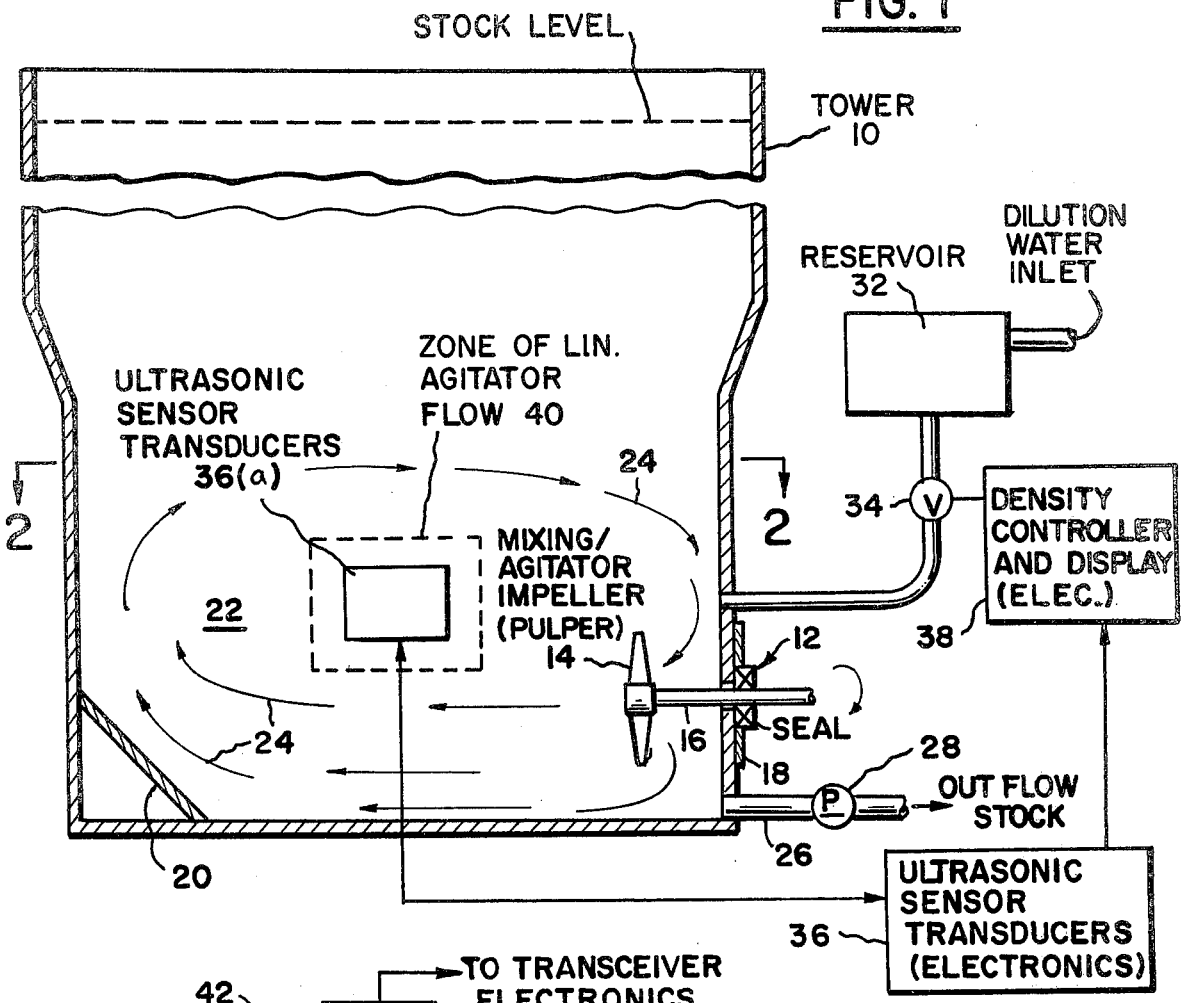
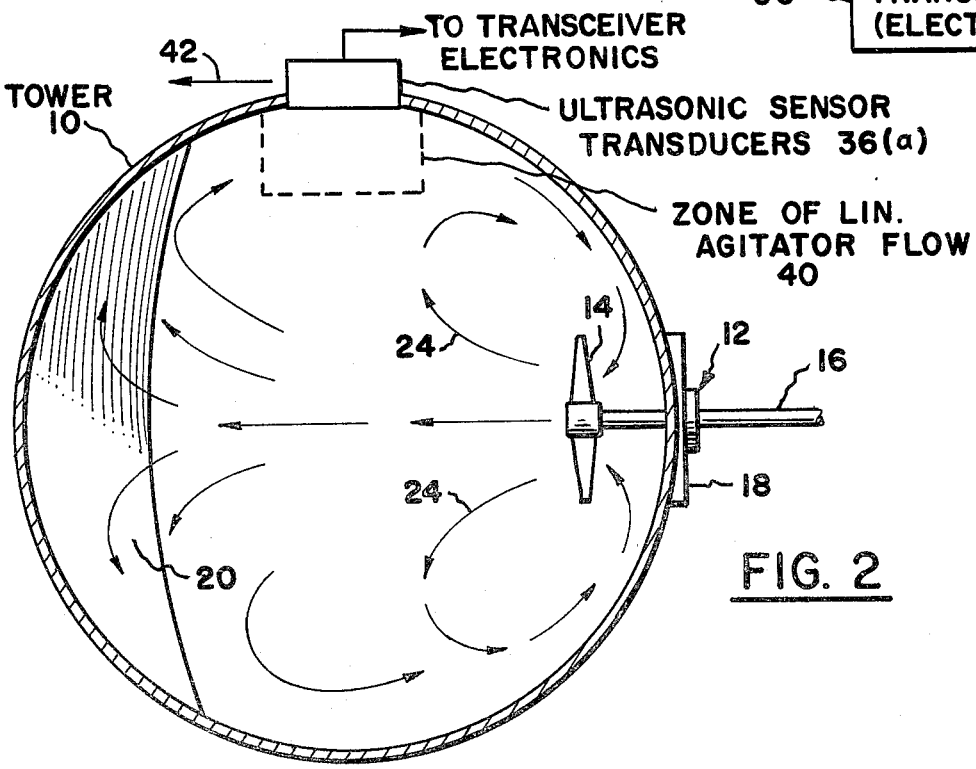
FIG. 2

APPARATUS, AND METHOD FOR CONTROLLING CONSISTENCY

DESCRIPTION

The present invention relates to the control of consistency of slurries, particularly paper stock used in paper making processes, and also to an improved method and apparatus for measuring the consistency of such slurries.

The invention is especially suitable for the control of consistency in a paper pulp or fiber stock tower which is a tank containing high density stock. The invention may also be applied for the measurement and control of consistency of other applications in paper making, as for example in blow tanks, stock chests, broke tanks, bleach plant towers as are used for chlorine retention, caustics extraction and hypochlorination. Other applications for the invention may be found wherever the consistency of materials which may be stored in slurry form requires measurement or control.

Consistency is a measure of the percent by weight of solids in a liquid slurry of such solids. It is a term well known and used in the pulp and paper making industry. Various devices have been proposed and are commercially available for the measurement and control of consistency of paper stock. Typically, consistency is measured in a pipe or other channel carrying the outflow of the paper stock from a tank. The dilution of the stock in the tank is controlled by controlling the supply of make-up water to the tank. In order to control consistency in this manner, the incoming stock must be higher in consistency than is desired to permit the controller to operate. Inasmuch as the measurement is made after the dilution process, the measurement does not accurately reflect the actual consistency of the material in the tank. Further dilution or trimming downstream from the tank and the measurement point may be required to obtain the consistency specified for the further processing of the material.

It has been discovered, in accordance with the invention, that accurate measurement and control of consistency can be obtained directly in the vessel or tank containing the slurry by utilizing the flow produced by the agitator or mixing impeller or pulper which circulates the slurry within a region of the vessel. The flow is preferably detected by a sonic flow sensor which responds to the velocity of the particles of material while the flow thereof is induced by shift in frequency between transmitted and received waves due to the Doppler effect. This velocity signal obtained from the sensor is used to vary the dilution of the slurry thereby controlling the consistency thereof. The addition of make-up material, such as dilutant, the outlet slurry of controlled consistency, as well as the measurement of consistency are all made in the same region of the tank where flow is occurring. The measurement and contol of consistency is closely coupled and is carried out without delay thereby resulting in maximum accuracy. Downstream dilution and trimming to obtain desired consistency can be eliminated in that lower consistencies of the material in the tank result in a reduction of size in the motor and drive for operating the agitator with the attendant conservation and saving of power.

Accordingly, it is a principal object of the present invention to provide an improved method and apparatus for the measurement and control of consistency in slurries which may be contained in a chest or tank.

It is a further object of the present invention to provide an improved method and apparatus for the measurement and control of consistency at low cost and with high accuracy.

The foregoing and other objects, features and advantages of the invention, as well as the best mode known for practicing the invention and a presently preferred embodiment thereof, will become more apparent from a reading of the following description in connection with the accompanying drawings in which:

FIG. 1 is a schematic diagram of consistency control apparatus in accordance with the invention showing the paper stock tower in which the components of the invention are installed in elevation;

FIG. 2 is a sectional plan view, taken along the line 2—2 in FIG. 1 so as to illustrate the location of the sensor and impeller components shown in FIG. 1.

Referring to FIG. 1 there is shown a tank 10 known as a stock tower which contains a slurry of pulp and/or fiber in water. Near the bottom of the tower 10 there is located a side entering agitator or mixer unit 12. The unit 12 has an impeller 14 or pulper at the end of a shaft 16. The shaft is driven by a motor drive (not shown), a flange and seal arrangement 18 holds the unit on the outside of the tower 10. The tower is cylindrical and has a vertical axis. It may, however, be rectilinear in horizontal cross section. A fillet 20 in the lower corner of the tank opposite to the impeller 14 aids the flow of the slurry induced by the impeller in a region 22 at the bottom of the tank. The arrows 24 generally indicate the direction in which the slurry circulates around the region 22 as it flows.

An outlet pipe 26 is coupled to the bottom of the tower 10 below the agitator 12. A pump 28 may be used to obtain an outlet flow of the stock through the pipe 26. It will be noted that the outlet is in the region 22 where flow is induced by the agitator 12.

Inlet of make-up material, illustrated as dilution water, is also into the region 22 where flow is induced by the agitator 12. An inlet pipe enters the region above the impeller and on the opposite side of the impeller from the outlet pipe 26. The dilutant water may be obtained from a reservoir 32 or other source of low pressure water which is connected to the inlet pipe. A throttle valve 34 in the pipe controls the flow of the dilution water, and therefore the amount of water which is added in order to obtain the desired consistency of the stock which flows through the outlet pipe 26.

A flow sensor 36 which detects the velocity or rate of movement (flow) of the slurry provides an output from which a measurement of consistency in the region 22 is derived. This sensor is preferably a sonic sensor which obtains a velocity measurement by the Doppler shift effect. The term sonic as used herein includes acoustic waves both audible and inaudible. The frequency of the waves depends upon the nature of the material upon the dimensions of the region 22. It has been found that a commercial ultrasonic sensor having a transceiver and sensor transducers **36*a* may be used. The transducer projects ultrasonic waves into the circulating slurry in the region 22. These waves are reflected from the particulate portion of the slurry and are frequency shifted, on average, in accordance with the average velocity of the particulate component of the slurry. This velocity measurement is obtained by an FM discriminator in the transceiver and provides an output signal to a display and density controller unit 38** on which a measurement of the consistency is obtained.

The output is used to control the valve 34, which may be an electromechanical servo valve, so as to increase and decrease the flow of dilution water, as measured velocity decreases and increases, so as to maintain the consistency of the slurry as it flows from the outlet pipe 22 at a predetermined consistency.

It has been found that the accuracy of the consistency measurement and the accuracy of consistency control is enhanced when the sensor transducers 36*a* are located in a zone 40 where the flow is linear. It has been found that this flow is linear in the inner wall surface where a tangent line 42 parallel to the axis of the shaft 16 of the agitator 12 intersects the wall surface at a height above the horizontal plane of the agitator shaft 16 which depends upon the nature of the slurry and the diameter of the tower. In order to present the sensor transducers 36*a* to the slurry in the zone of linear agitator flow 40 a plate in which the transducers are mounted may be installed in place of a section of the wall of the tower 10 as shown in FIG. 2. The zone of the linear flow (i.e. wherein the slurry is moving at linear velocity) may be at another location than along the inside wall of the tank as shown in FIGS. 1 and 2, when the tank cross-section is not circular. In such cases the transducers may be mounted on a support so as to extend from the wall or bottom of the tank into the zone. Such mounting is not preferred in that it may interfere with the flow pattern and may have to be maintained to clear stock which is deposited thereon.

Variations and modifications of the herein described apparatus and practice of the invention, will undoubtedly suggest themselves to those skilled in the art. For example various pulp or fiber chest may be used other than the illustrated stock tower 10. Accordingly, the foregoing description should be taken as illustrative and not in a limiting sense.

I claim:

1. Apparatus for controlling the consistency of a slurry containedin a tank which comprises an agitator for producing a flow of said slurry in said tank, liquid velocity sensor means for sensing said flow, said sensor being located adjacent to a surface of the tank at a region where said slurry flow is linear, means for providng an output corresponding to the sensed flow, and means responsive to said output for varying the dilution of said slurry to control the consistency thereof.

2. The apparatus as set forth in claim 1 further comprising an inlet for the entry of diluting medium into said tank adjacent said agitator.

3. The apparatus as set forth in claim 2 further comprises valve means, means for pressurizing the flow of said diluting medium through said valve means, and means for operating said valve means in response to said output for throttling the flow of said diluting medium therethrough into said tank.

4. The apparatus as set forth in claim 2 further comprising outlet means for delivering said slurry and having an opening into said tank spaced closer to the bottom of said tank than said inlet, and said agitator being disposed between said inlet and said outlet means.

5. The apparatus as set forth in claim 1 wherein said agitator comprises a unit entering said tank from the side thereof and having a shaft with an impeller thereon, said shaft having its axis generally perpendicular to a vertical axis in said tank.

6. The apparatus as set forth in claim 5 wherein said sensor means comprises a sensing element disposed upon the wall of said tank.

7. The apparatus as set forth in claim 6 wherein said tank is cylindrical in said region and said second plane contains a line tangent to the wall of said tank parallel to said shaft axis.

8. The apparatus as set forth in any of claims 1, or 3–7 wherein said sensor means is a Doppler effect responsive sonic flow sensor means which provides an electrical signal corresponding to the velocity of said slurry as said output, and having transducer element means for projecting and receiving sonic waves.

9. The invention as set forth in claim 1 wherein said slurry comprises a source of paper stock.

10. The method of controlling the consistency of slurries such as paper stock and the like, which comprises the steps of agitating the slurry to produce a circulating flow thereof in the tank containing the slurry, measuring the flow of said slurry adjacent to a surface of the tank at a region where said flow is linear, in response to the flow measurement adding makeup material into said region and removing said slurry from said region while measuring said flow so as to maintain a predetermined consistency in the slurry which is removed from said tank.

11. The method according to claim 10 wherein said makeup material is dilutant for decreasing the consistency of said slurry.

12. The method according to claim 10 wherein said measuring step is carried out by transmitting into and receiving sonic waves from said slurry to detect the velocity of the flowing particles constituting said slurry.

13. Apparatus for the measurement of the consistency of a slurry contained in a vessel comprising an agitator for producing a circulating flow of said slurry in said vessel, means for detecting the velocity at which said slurry flows in said vessel said detecting means being located adjacent to a surface of the tank at a region where said slurry flow is linear, means for providing an output corresponding to the detected flow, and means for deriving from said output a measurement of the consistency of said slurry.

14. The apparatus according to claim 13 wherein said detecting means is a sonic sensor responsive to the Doppler frequency shift of sonic signals transmitted into said slurry while it flows.

15. The method for measurement of consistency of a slurry in a tank which comprises the steps of agitating said slurry with an impeller to produce a circulating flow of said slurry in a said tank, then detecting the velocity at which said slurry flows adjacent to a surface of the tank at a region where said flow is linear, and deriving a measurement of consistency from said velocity.

16. The method as set forth in claim 15 wherein said detecting step is carried out by transmitting and receiving sonic waves from said slurry and measuring the Doppler shift in the frequency between said transmitted and received sonic waves.

* * * * *